United States Patent [19]

Payne et al.

[11] Patent Number: 4,491,256

[45] Date of Patent: Jan. 1, 1985

[54] DRYING INSERT FOR CAPS

[76] Inventors: Paul E. Payne, 1415 Maxmillian Pl.; Charles F. McDonagh, 1640 W. Sage St., both of Tucson, Ariz. 85704

[21] Appl. No.: 439,826

[22] Filed: Nov. 8, 1982

[51] Int. Cl.[3] ..... B65H 25/24

[52] U.S. Cl. ..... 223/24; 223/25

[58] Field of Search ..... 223/24, 25, 26

[56] References Cited

U.S. PATENT DOCUMENTS

| | | | |
|---|---|---|---|
| 1,703,398 | 2/1929 | Lake | 223/24 |
| 1,740,008 | 12/1929 | Diener | 223/24 |
| 2,704,176 | 3/1955 | Smith | 223/25 |
| 2,812,887 | 11/1957 | Palinkas | 223/24 |
| 4,011,973 | 3/1977 | Leach | 223/25 |

*Primary Examiner*—Louis K. Rimrodt

*Attorney, Agent, or Firm*—Cahill, Sutton & Thomas

[57] ABSTRACT

A drying insert for caps of the kind having stiff visors which wrinkle badly after being laundered and dried includes a rigid visor-shaped section to be pressed against the wet visor of a laundered cap and a crown section having a plurality of spaced arches. The crown section of the drying insert is forced snugly into the crown section of a wet freshly laundered cap, pressing the rigid visor-shaped section against the bottom surface of the wet visor of the cap. Means are provided for holding the visor against the rigid visor-shaped section of the insert, so that the cap retains its original shape as it is dried.

6 Claims, 7 Drawing Figures

DRYING INSERT FOR CAPS

BACKGROUND OF THE INVENTION

The invention relates to removable devices for preventing caps with visors from becoming badly wrinked as they dry after being laundered.

By way of background, it is noted that inexpensive cloth caps of the type having a crown (which is often partially ventilated) and a visor which extends outward from the wearer's forehead are commonly worn by workers in various industries. These caps are very inexpensive and are so popular that some business concerns give such caps away to their customers for good will; often, the business concern has its name or trademark imprinted on the cap. Employees of such customers appreciatively receive these caps and wear them, but usually get them quite dirty in a short time. Such caps are, of course, quite unattractive when they become soiled by grease, dirt and other adherent substances which seem to inevitably get deposited thereon. Although these caps usually are made of cloth material which can be laundered, they usually include sewn-in stiffeners or stays which maintain the shape of the visor, and sometimes also include stays which maintain the shape of the crown portions of the caps. These stays are often made of a cardboard-like material which wrinkles badly as it drys after the cap is laundered, causing the bill of the cap (and sometimes also the crown) to become badly misshaped. Consequently, workers rarely launder such caps, and usually simply wear them until they become excessively filthy and unattractive, especially if it is inconvenient to obtain a replacement cap. Although construction workers and others who wear such caps and get them dirty are usually not overly concerned that their working apparel be spotless, nevertheless, they ordinarily like to have all items of their clothing, including their caps, capable of being laundered. The necessarily low cost which must be maintained to ensure widespread distribution and use of such caps apparently has resulted in a small market of more expensive caps with stays that are removable during laundering, such as those shown in U.S. Pat. Nos. 2,681,451, 2,718,010, and U.S. Pat. No. 3,133,289, or stiffeners which can withstand cleaning without being wrinkled during either the cleaning operation or the drying operation, such as the ones disclosed in U.S. Pat. No. 2,704,847. Although numerous drying racks and devices that stretch various articles of clothing to cause them to dry without wrinkling are known, no such drying devices have ever been proposed for caps of the kind described above. Apparently, the industry has failed to meet the need for such a device because no one has ever conceived of a sufficiently simple and workable structure that is capable of causing cheap caps of the type described to dry in their proper shape and yet is sufficiently low in cost to be economical. When it is considered that there are many millions of such caps used every day, it becomes clear that there is an unmet need for a practical, inexpensive means for laundering such caps and causing them to maintain their proper shape while being dried, since the market for such caps has determined that the cost of making them with non-wrinkling stays and inserts is too high.

Accordingly, it is an object of the invention to provide a means of laundering caps of the type having inserts and/or stays which wrinkle badly during drying after being laundered.

It is another object of the invention to avoid the need for wearing such caps when they become excessively soiled or for discarding them before they are worn out.

SUMMARY OF THE INVENTION

Briefly described and in accordance with one embodiment thereof, the invention provides a cap drying insert for a cloth cap of the kind having a visor and a stay or insert therein which wrinkles badly while the cap is being dried after being laundered, the cap drying insert including a rigid visor-shaped section that conforms to the original shape of the visor of the cap and also including a rigid crown-shaped section that conforms to the shape of the crown of the cap and is composed of a plurality of rigid arch-shaped members that come together at the top of the crown-shaped section and are peripherally spaced and attached to a ring at their lower ends, the ring being attached to the visor-shaped section.

In use, after the cap is laundered, and while it is still wet, the crown-shaped section of the cap drying insert is forced into the crown of the cap to stretch it and to press the upper surface of the visor-shaped section of the cap drying insert against the visor of the cap. Means are provided for clamping or otherwise pressing the wet visor of the cap against the rigid visor-shaped section of the cap drying insert, thereby maintaining the shape of the visor of the cap as it drys and preventing wrinkling thereof.

In one described embodiment of the invention, the visor-shaped section, the ring, and the crown section are all integral and are composed of injection-molded plastic.

DESCRIPTION OF THE INVENTION

Figure 1:
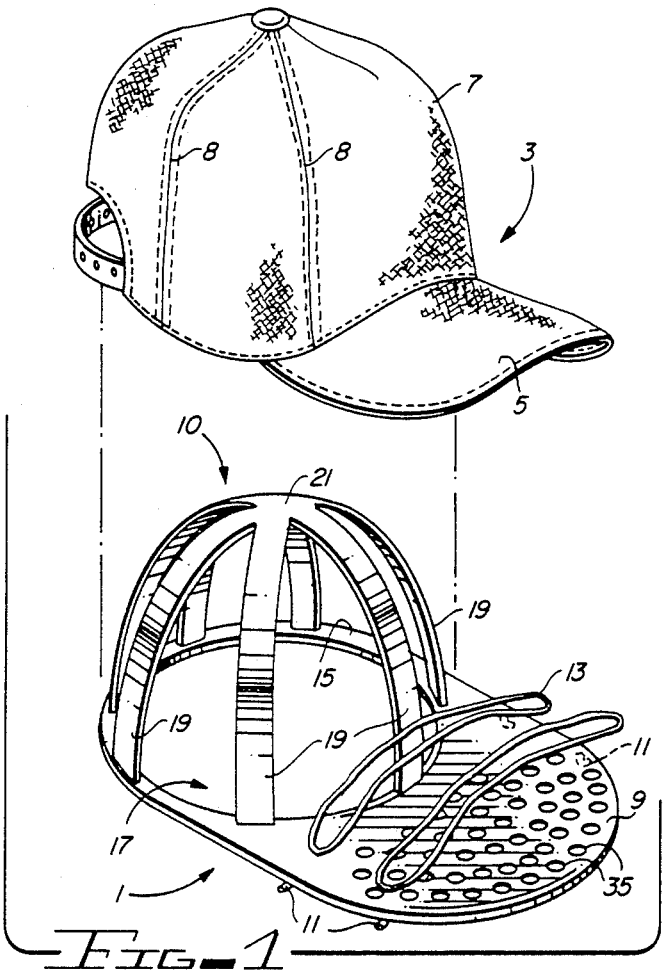
FIG. 1 is a perspective view illustrating the structure and use of one embodiment of the invention.
Figure 2:
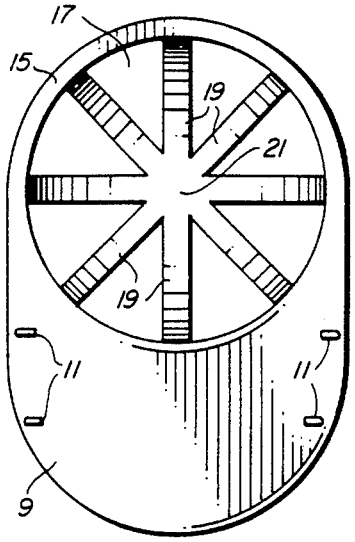
FIG. 2 is a bottom view of the cap-drying insert of FIG. 1.
Figure 3:
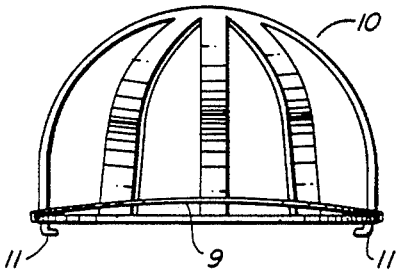
FIG. 3 is a front view of the cap-drying insert of FIG. 1.

Referring now to the drawings, especially FIGS. 1–3, reference numeral 1 generally designates the cap-drying insert of the present invention. Reference numeral 3 generally designates a cap of the type with which the cap-drying insert is used. Cap 3 includes a stiff, slightly curved visor 5, which is attached to a crown section 7. Dotted lines 8 represent portions of the crown section which typically wrinkle badly during drying after cap 3 has been laundered. Visor 5 typically has the above-mentioned cardboard-like insert therein which becomes flexible when wet, and then wrinkles and drys into a stiff, wrinkled configuration.

Cap-drying insert 1 includes a rigid visor section 9, the upper surface of which is shaped to conform to the curvature of visor 5 of cap 3 before it is laundered. Reference numeral 15 designates a ring which is attached to and preferably is integral with visor-shaped section 9. Reference numerals 19 represent six arched-shaped members which come together at the point designated by reference numeral 21 and are roughly equally spaced at their lower ends and are attached to and preferably are integral with ring 15 and visor-shaped section 9. The size and configuration of the crown section 10, which is composed of ring 15 and arch-shaped members 19, is such that the crown section 7 of cap 3 has to be stretched slightly when it is wet in order to force the crown section 10 of cap-drying insert 1 into the crown of cap 3.

In use, when crown section 10 of cap-drying insert 1 is fully inserted into the crown 7 of cap 3, the upper surface of visor-shaped section 9 presses upward against the bottom surface of wet visor 5 of cap 3.

Reference numeral 13 designates two rubber bands which can be stretched over the top of visor 5 when it is pressed against visor-shaped section 9. The ends of rubber bands 13 are looped over the hooks designated by reference numeral 11, thereby holding visor 5 against the upper surface of visor-shaped section 9 during the entire period during which the cap 3 is being dried, thereby causing its cardboard-like insert to maintain its original configuration during the entire drying process. Although only two rubber bands 13 are shown in the figure, as many can be provided as are necessary to reliably hold bill 5 against the upper surface of bill-shaped plate 9 during the entire drying process.

Various variations on the device shown in the drawing are all quite possible. For example, peripheral clips could be provided, either separately or integrally attached to visor-shaped section 9 to clip the periphery of visor 5 to visor-shaped section 9. In yet another alternative, an upper plate similar in shape to plate 9 could be placed over the top of visor 5, thereby sandwiching visor 5 between such upper plate and plate 9, and suitable peripheral clamping elements could be used to press visor 5 between the two visor-shaped plates until it is dry. A suitable number of perforations such as 35 in FIG. 1 could be provided in one or both such visor-shaped plates to allow rapid drying, yet maintain the necessary stiffness needed to maintain visor 5 in its original shape during drying. The upper visor-shaped plate could even be hinged to the lower one, integral clips being provided to press it against the visor of the cap 3.

Figure 4:
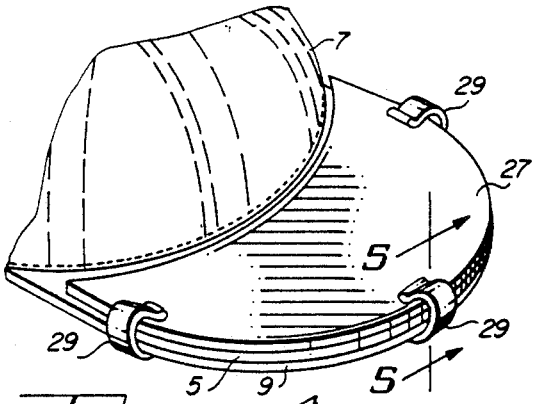
FIG. 4 is a partial perspective view of an alternate embodiment of the invention.
Figure 6:
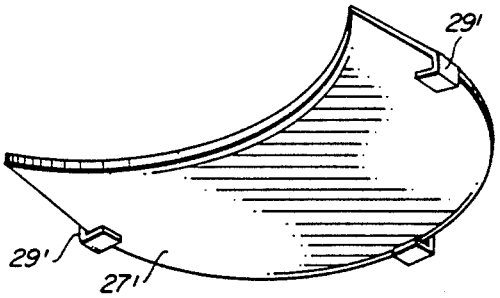
FIG. 6 is a perspective view of an alternate plate that can be used to press the visor of the cap against the visor-shaped section of the insert shown in FIG. 4.
Figure 5:
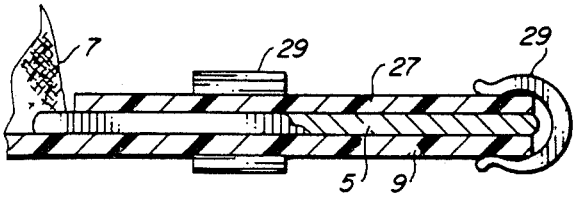
FIG. 5 is a partial section view taken along section line 5—5 of FIG. 4.
Figure 7:
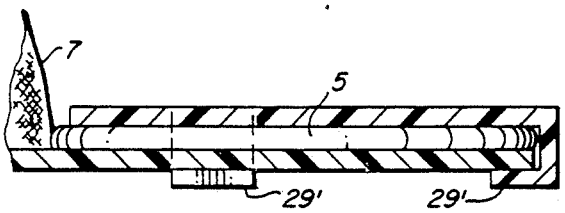
FIG. 7 is a section view useful in explaining the use of the device shown in FIG. 6.

Several such alternate embodiments of the invention are shown in FIGS. 4–7. In FIGS. 4 and 5, an upper visor-shaped plate 27 is pressed by means of C-shaped clips 29 against the upper section of visor 5 and the upper surface of visor-shaped section 9 is pressed against the lower surface of visor 5 by the peripheral clips 29. In FIGS. 6 and 7, a slightly modified version of the device shown in FIGS. 4 and 5 is illustrated, wherein peripheral clips 29' that are integral with upper visor-shaped plate 27' are provided. Clips 29' can be bent outward slightly so that they extend around the periphery of visor 5 of the cap and around the periphery of visor-shaped section 9 of cap-drying insert 1, as shown in FIGS. 7.

The cap-drying insert 1 is preferably composed out of a relatively stiff injection molded plastic material, such as polypropalene.

While the invention has been described with reference to several particular emobdiments thereof, those skilled in the art will be able to make various modifications to the disclosed embodiments of the invention without departing from the true spirit and scope thereof.

We claim:

1. A generally rigid insert for drying a cap having a visor and a crown section, said visor having a lower surface that is generally concave when dry, said insert comprising in combination:

(a) a first section having a generally convex upper surface that generally conforms to said generally concave lower surface shape of said visor of said cap;

(b) a second section having an upper surface that generally conforms to the proper shape of said crown section, said second section being attached to said first section, said second section including a plurality of arched members and a ring that is attached to said first section, the upper ends of said arched members coming together and being connected together at the top of said second section, the lower ends of said arched members being spaced apart and connected to said ring, the size of said second section causing said crown section of said cap to be stretched over said arched members when said second section is inserted into said crown section of said cap shortly after laundering of said cap, said upper surface of said first section being pressed against the lower surface of said visor when said second section is inserted sufficiently far into said crown section of said cap to stretch said crown section of said cap over said arched members; and (c) means connected to said first section for holding said lower surface of said visor against said generally convex upper surface of said first section when said visor is wet so that said lower surface of said visor conforms to the shape of said upper surface of said first section to prevent wrinkling of said visor while said cap is drying, wherein said visor holding means includes a plurality of elements attached to the peripheral portion of said first section and a plurality of elastic band means for being stretched between said elements and over the upper surface of said visor to hold its generally concave lower surface against said generally convex upper surface of said first section.

2. The generally rigid insert of claim 1 wherein said first and second sections are integral.

3. The generally rigid insert of claim 2 wherein said first and second sections are composed of plastic.

4. The generally rigid insert of claim 3 including approximately six of said arched shaped members, each of said arched-shaped members being generally strap-shaped.

5. The generally rigid insert of claim 1 wherein said first section is perforated to allow circulation of air to more rapidly dry said visor.

6. A generally rigid insert for drying a cap having a visor and a crown section, said visor having a lower surface that is generally concave when dry, said insert comprising in combination:

(a) a first section having a generally convex upper surface that generally conforms to said generally concave lower surface shape of said visor of said cap;

(b) a second section having an upper surface that generally conforms to the proper shape of said crown section, said second section being attached to said first section, said second section including a plurality of arched members and a ring that is attached to said first section, the upper ends of said arched members coming together and being connected together at the top of said second section, the lower ends of said arched members being spaced apart and connected to said ring, the size of said second section causing said crown section of said cap to be stretched over said arched members when said second section is inserted into said crown section of said cap shortly after laundering of said cap, said upper surface of said first section being pressed against the lower surface of said visor when said second section is inserted sufficiently far into said crown section of said cap to stretch said crown section of said cap over said arched members; and (c) means connected to said first section for holding said lower surface of said visor against said generally convex upper surface of said first section when said visor is wet so that said lower surface of said visor conforms to the shape of said upper surface of said first section to prevent wrinkling of said visor while said cap is drying, wherein said visor holding means includes an upper member having a generally concave lower surface that conforms to the proper shape of said visor, said upper member pressing said visor between said generally convex upper surface of said second section and said generally concave lower surface of said upper section during drying of said cap, said visor holding means also including clamping means for clamping said upper section against said second section with said visor disposed therebetween.

* * * * *